US008157956B2

(12) United States Patent
Weston et al.

(10) Patent No.: US 8,157,956 B2
(45) Date of Patent: Apr. 17, 2012

(54) CYLINDRICAL BEARING FOR PRESSURE DIFFUSER AND ASSOCIATED METHOD

(75) Inventors: John Weston, Queensbury, NY (US); Carl Luhrmann, Glens Falls, NY (US); Keith Vogel, Queensbury, NY (US); Grant Bechard, Queensbury, NY (US); James Oropallo, Gansevoort, NY (US); Mark Wilkinson, Huntington, MA (US)

(73) Assignee: Andritz Inc., Glens Falls, NY (US)

( * ) Notice: Subject to any disclaimer, the term of this patent is extended or adjusted under 35 U.S.C. 154(b) by 238 days.

(21) Appl. No.: 12/635,854

(22) Filed: Dec. 11, 2009

(65) Prior Publication Data

US 2010/0155003 A1 Jun. 24, 2010

Related U.S. Application Data

(60) Provisional application No. 61/140,467, filed on Dec. 23, 2008.

(51) Int. Cl.
*D21C 9/04* (2006.01)

(52) U.S. Cl. ..... 162/60; 210/323.2

(58) Field of Classification Search ..... 162/60
See application file for complete search history.

(56) References Cited

U.S. PATENT DOCUMENTS

| | | | | |
|---|---|---|---|---|
| 2,298,584 | A * | 10/1942 | Onions | 277/468 |
| 3,770,285 | A * | 11/1973 | Grover | 277/435 |
| 5,567,279 | A | 10/1996 | Phillips et al. | |
| 6,834,862 | B2 | 12/2004 | Wilkinson | |
| 2003/0217822 | A1 | 11/2003 | Weston et al. | |

OTHER PUBLICATIONS

Metso Pressure Diffuser Borchure, Nov. 2009.*
"Pack-RYT" brochure published by Seal-Ryt Corp (prior to Dec. 2009)(7 pages).
Seal-RYT Corp., Product Information Sheets for PACK RYT (4 pages).

* cited by examiner

*Primary Examiner* — Anthony Calandra
(74) *Attorney, Agent, or Firm* — Nixon & Vanderhye P.C.

(57) ABSTRACT

A bearing cylinder for a screen assembly of a pressurized pulp diffuser, the bearing cylinder including: a plurality of segments of the bearing cylinder wherein the segments are arranged side-by-side to form the bearing cylinder; and each of said segments includes a first region formed of a hard material resistant to damage from sand and rocks, and a second region formed of a soft material that thermally expands and conforms to bearing surfaces opposite to the bearing cylinder.

15 Claims, 5 Drawing Sheets

CYLINDRICAL BEARING FOR PRESSURE DIFFUSER AND ASSOCIATED METHOD

RELATED APPLICATION

This applications claims priority to U.S. Provisional Patent Application Ser. No. 61/140,467 filed Dec. 23, 2008, the entirety of which application is incorporated by reference.

BACKGROUND

The invention disclosed herein relates generally to pressure diffusers for washing pulp and particularly relates to upper and lower cylindrical bearings between a moving screen assembly and stationary bearing cylinders in the pressure diffuser.

The term "pulp" generally refers to comminuted cellulosic material, such as wood chips that have been processed in a digester to separate the fibers in the wood. Chemicals, e.g., liquor, are injected into the digester vessel to process the pulp. After the pulp is discharged from the digester vessel, the pulp may have residual amounts of chemicals.

The pulp flow from the digester vessel to a pressurized diffuser that washes the pulp to remove the residual chemicals. A pressurized diffuser is typically a large vessel, e.g., 50 feet in height or greater. Pulp with chemicals enters an annular space inside the diffuser. Wash water is injected into the annular space and flows through the pulp to remove the chemicals from the pulp. The wash water with chemicals (referred to as "wash filtrate") passes from the annular space through slots in an internal screen assembly. The slots allow the wash filtrate to pass through to an internal chamber at the center of the screen assembly. The slots in the screen assembly are too narrow to pass the fibers or other particles in the pulp. The cleaned pulp is typically discharged from the top of the pressurized diffuser. The wash filtrate is typically discharged from a bottom outlet in the pressure diffuser.

The screen assembly moves within the pressure diffuser. Traditionally, the screen assembly moves reciprocally up and down during operation of the pressure diffuser. The screen assembly may also rotate during operation. The movement of the screen assembly promotes the flow of pulp through the annulus in the diffuser. Particularly, the movement of the screen assembly assists in clearing the slots of fibers and particles that may be blocking the slots.

Cylindrical bearings support the screen assembly in the pressure diffuser. The bearings allow the screen assembly to move vertically with respect to the diffuser housing. The bearings are arranged at upper and lower regions of the diffuser. The bearings are sandwiched between the screen assembly and a stationary bearing cylinder in the pressure diffuser.

The cylindrical bearings are adjacent the upper and lower ends of the annular space containing the pulp. A difficulty with conventional cylindrical bearings has been that sand, fiber, rocks and other impurity particles in the pulp inadvertently enter the gap between the screen assembly and the bearing cylinder, and become caught against a surface of the cylindrical bearing. These impurity particles damage the surface of the bearing cylinder, such as by gouging the surface and forming grooves and other imperfections in the surface of the cylindrical bearing. The damaged surface of the bearing cylinder tends to allow fibers from the annular region with the pulp to move past the bearing cylinder and enter the filtrate chamber in the center of the screen assembly.

The damaged surface of the bearing cylinder can also lead to permanent failure of the bearings. Additionally, the difficulty with sand and impurity particles entering the annular space between the cylindrical bearings and the bearing surfaces is most pronounced when the cylindrical bearing is cool. When cool, conventional cylindrical bearings contract and open gaps between the bearing and the bearing cylinder.

Conventional bearings are formed of a soft plastic material, e.g., a polytetrafluoreoethylene (PTFE) or other fluorocarbon plastic such as Rulon™, that expands under heat. The thermal expansion of the conventional bearings creates a tight seal between the bearing surfaces, e.g., the screen assembly and stationary bearing, and the cylindrical bearing. The expansion coefficient of conventional cylindrical bearings has been about ten (10) times the expansion coefficient of the metal materials, e.g., stainless steel, used to form the bearing surfaces in the screen assembly and bearing. The pressure diffuser typically can operate at temperatures of up to 330 degrees Fahrenheit (F.) and about 150 degrees Celsius (C.). At these elevated temperatures, conventional cylindrical bearings have expanded to form tight seals in the gap between the screen assembly bearing surface and a bearing surface of a bearing in the pressure diffuser.

When the pressure diffuser has cooled, such as when taken off-line for maintenance and service, the temperature of the cylindrical bearings may drop to ambient temperatures, such as 32 degrees F. or to zero degrees C. At these cooler temperatures, the cylindrical bearings contract and open a gap between the bearings and the bearing surfaces on the screen assembly and bearing. The gap between a cooled cylindrical bearing and the bearing surfaces may be sufficient to allow sand and other impurity particles to enter and become trapped against the bearing when the pressure diffuser heats during operation.

When the cylindrical bearing is cool, sand, rocks and other impurity particles become trapped against and embed in the soft surfaces of the cylindrical bearing. The embedded sand, rocks and other particles scrape against the surface of the bearing cylinder as the screen assembly (with cylindrical bearing) moves reciprocally up and down, and may rotate. The scraping of sand, rock and other particles can damage the bearing cylinder.

The damage caused by sand and other impurity particles to cylindrical bearings in a pressure diffuser has created a long felt need for an improved cylindrical bearing. The damage to the bearings results in fibers entering the filtrate extracted from the pulp and impurities. Because of the damage caused by sand and other impurities, the cylindrical bearings are replaced periodically. The replacement of the bearings requires the pressure diffuser to be taken off-line and results in an interruption in the pulp cleaning process and, thus, loss of time and money due to repair and maintenance of the diffuser and lost pulp production.

Typically, cylindrically bearings are replaced every year or every year and an a half. However, the cylindrical bearings may require more frequent replacement, such as three or four times a year, if the damage to the bearing due to impurity particles causes an excessive amount of fibers to enter the filtrate. There is a need for improved cylindrical bearings that are less susceptible to the encroachment of sand and other impurity particles into the space occupied by the bearing. Preferably, the improved cylindrical bearings will have an operational life of at least one year, even when operating with pulp having relatively large amounts of fine sand or other small particulate impurities.

SUMMARY

A cylindrical bearing for a pressure diffuser has been invented comprising, in one embodiment, a first annular section formed of a hard material and a second annular section formed of a softer material, both of which materials thermally expand when the pressure diffuser is heated to its operating temperature. Preferably, the first annular section is adjacent a pulp filled annular chamber of the pressure diffuser. The first annular section fits tightly in a gap between the screen assembly and bearing cylinder.

The first annular section may be formed of, for example, materials such as a non-ferrous metallic material, such as molybdenum, a carbon or glass filled thermoplastic material, such as polytetrafluoroethylene (PTFE), a graphite, a composite of graphite and a metal, and a ceramic. The hardness of the first annular section does not readily gouge or become damaged when sand and other impurity particles become caught between the section and the bearing cylinder. The hardness of the first annular section prevents sand, rocks and other particles from becoming embedded in its surface. Without sand, rock and other particles embedded in the first annular section, the cylindrical bearing is less likely to damage the bearing cylinder as the screen assembly moves up and down.

The first annular section prevents sand, rocks and other impurity particles in the pulp from migrating to the softer second annular section of the cylindrical bearing. By preventing sand, rocks and impurity particles from reaching the softer second annular section, the amount of sand, rock and impurity particles becoming embedded in the second annular section is eliminated or reduced, as compared to conventional cylindrical bearings made only of a soft material. Without sand, rock or other particles embedded in the first or second annular sections, the cylindrical bearing may move reciprocally in the bearing cylinder without damaging (or at least only minimally damaging) the surface of the bearing cylinder.

The first annular section also aligns the screen assembly radially with respect to the bearing cylinder and the pressure diffuser, especially during start-up operations of the pressure diffuser. The first annular section is hard and thick, at least as compared to the second annular section. The cylindrical bearing is affixed section by section to the screen assembly. With the cylindrical bearing affixed, the screen assembly is seated in the bearing cylinders in the upper and lower region of the pressure diffuser. When seated, the cylindrical bearing—and particularly the first annular section of the bearing—aligns the screen assembly radially in the bearing cylinders and the pressure diffuser.

The second annular section may be formed of a PTFE plastic, such as Rulon™ that is relatively soft as compared to the first annular section. The materials forming the first and second annular sections preferably have thermal coefficients of expansion several orders of magnitude, e.g., ten, greater that then thermal expansion coefficient of the metals forming the screen assembly and the bearing cylinder. As the second annular section expands when heated to the operating temperature of the pressure diffuser, it deforms to fit tightly in the gap between the screen assembly and the bearing cylinder. The expanded and deformed second annular section forms a seal in the gap that prevents fibers from the pulp from migrating through the gap and into the filtrate chamber within the pressure diffuser.

In one embodiment, the invention is a bearing cylinder for a screen assembly of a pressurized pulp diffuser, the bearing cylinder including: a plurality of segments of the bearing cylinder wherein the segments are arranged side-by-side to form the bearing cylinder; and each of said segments includes a first region formed of a hard material resistant to damage from sand and rocks, and a second region formed of a soft material that thermally expands and conforms to bearing surfaces opposite to the bearing cylinder.

In another embodiment, the invention is a bearing assembly for a pressure diffuser comprising: a screen assembly having an annular mounting surface; a bearing cylinder coaxial with the screen assembly and having an annular bearing surface facing the mounting surface of the screen assembly; an annular gap between the mounting surface of the screen assembly and the bearing surface of the bearing cylinder; a cylindrical bearing mounted on the mounting surface and positioned in the gap, wherein the cylindrical bearing includes a first annular region formed of a hard material having a thickness greater than a second annular region formed of a soft material, wherein as the soft material thermally expands it deforms to form a tight seal between the screen assembly and the bearing cylinder.

In a further embodiment, the invention is a method to minimize damage to a bearing cylinder in a pressure diffuser comprising: affixing a cylindrical bearing to a screen assembly, wherein the cylindrical bearing includes a first annular section formed of a hard material and a second annular section formed of a soft material, which is softer than the hard material; seating the screen assembly with the cylindrical bearing in a bearing cylinder to mount the screen assembly in the pressure diffuser, wherein the cylindrical bearing is adjacent the bearing cylinder; washing pulp in an annular chamber and extracting filtrate from the pulp, through the screen assembly and into a filtrate chamber; preventing sand, rock and other particles and other particles in the pulp from embedding in a surface of the first annular section due to the hard material of the first annular section; blocking by the first annular section, the sand, rock and other particles in the pulp from migrating through a gap between the cylindrical bearing and the bearing cylinder to the second annular section, and moving the screen assembly with cylindrical bearings with respect to the bearing cylinders, wherein the sand, rock and other particles are not substantially embedded in the first annular section or the second annular section of the cylindrical bearing.

SUMMARY OF THE DRAWINGS

FIGS. 4, 5 and 6 are front, top and cross-sectional views, respectively, of a section of the bearing cylinder, wherein FIG. 5 is a top view taken along line 5-5 in FIG. 4 and FIG. 6 is a cross-sectional view taken along line 6-6 in FIG. 4.

DETAILED DESCRIPTION

Figure 1:
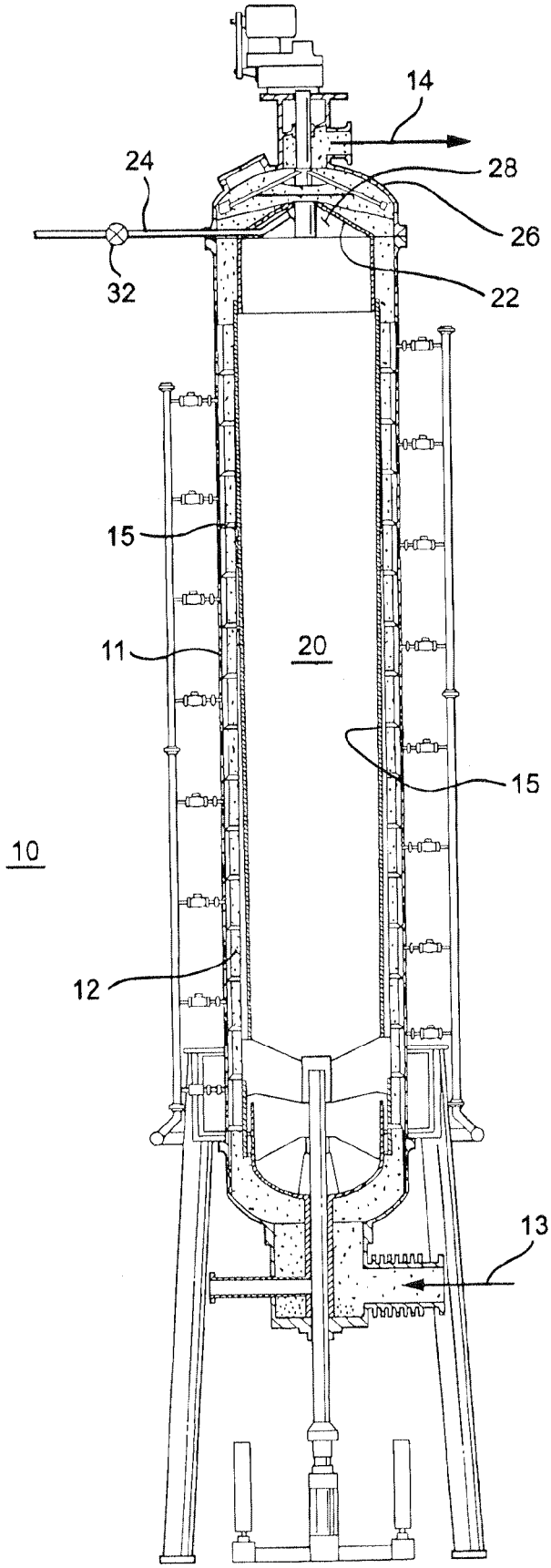
Fig. 1 (PRIOR ART)
FIG. 1 is a side schematic cross-sectional view of an exemplary conventional variable pressure diffuser.

FIG. 1 shows a conventional variable pressure diffuser 10 comprising a generally upright, liquid tight, pressurized vessel 11. Within the vessel is a first annular chamber 12 for comminuted cellulosic fibrous material (cellulosic pulp) to be treated under pressure. The pulp inlet 13 is typically at the bottom of the vessel and the pulp outlet 14 is typically at the top of the vessel. An internal screen assembly 15 includes a cylindrical screen extending the vertical length of the vessel. The screen defines an inner wall of the first annular chamber 12. The wall of the vessel 11 defines an outer wall of the first annular volume. Exemplary pressure diffusers are shown in the U.S. Pat. No. 5,567,279 and U.S. Patent Application Publication 2003/0217822, both of which are incorporated by reference in their entirety.

Wash water or liquor is injected to the first annular volume through an array of injectors 9 arranged outside of the wall of the pressure vessel 11 and supplied with liquid through a network of wash liquid conduits 8. The water is injected into the pulp in the first annular chamber 12. Wash filtrate is extracted through slots in the cylindrical screen of the screen assembly and collected in a large center chamber 20. The filtrate is discharged from the chamber 20 through a filtrate output 21 in the bottom of the vessel.

Figure 2:
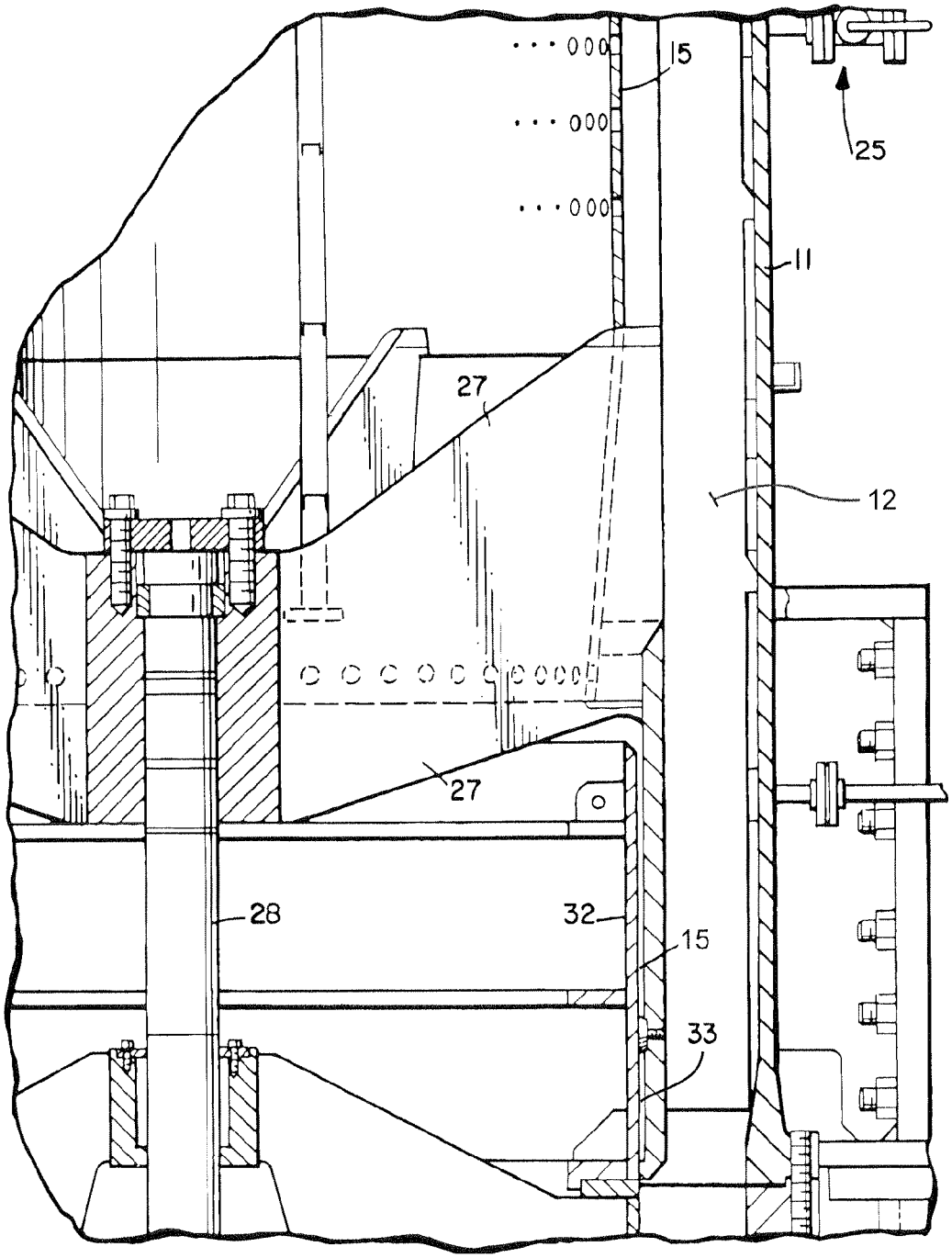
Fig. 2 (PRIOR ART)
FIG. 2 is a side schematic cross-sectional view of a lower region of the pressure diffuser shown in FIG. 1, which shows the cylindrical bearing between the screen assembly and the bearing cylinder.

FIG. 2 is a cross-sectional view of a lower portion of the pressure diffuser vessel 11. The screen assembly 15 includes a lower spider support 27 that includes radial support arms extending between the screen cylinder and a collar that is fixed to a center shaft 28. The center shaft drives the reciprocal movement (see double headed line) of the screen assembly. This reciprocal movement is preferably about 24 to 30 inches.

A cylindrical bearing 33 is attached to an outer surface of a lower region of the screen assembly. The cylindrical bearing 33 is sandwiched between the lower region of the screen assembly and a cylindrical bearing cylinder 32. Preferably, the cylindrical bearing 33 fills the gap between a surface of the screen assembly and a surface of the bearing cylinder 32. By filling the gap, the cylindrical bearing seals the gap and prevents the passage of pulp fibers from the annular chamber 12, through the gap and into the center chamber 20 of the screen assembly. In one embodiment, the cylindrical bearing may be three-quarters of an inch thick (20 millimeters) and seven inches (178 mm) in height.

Figure 3:
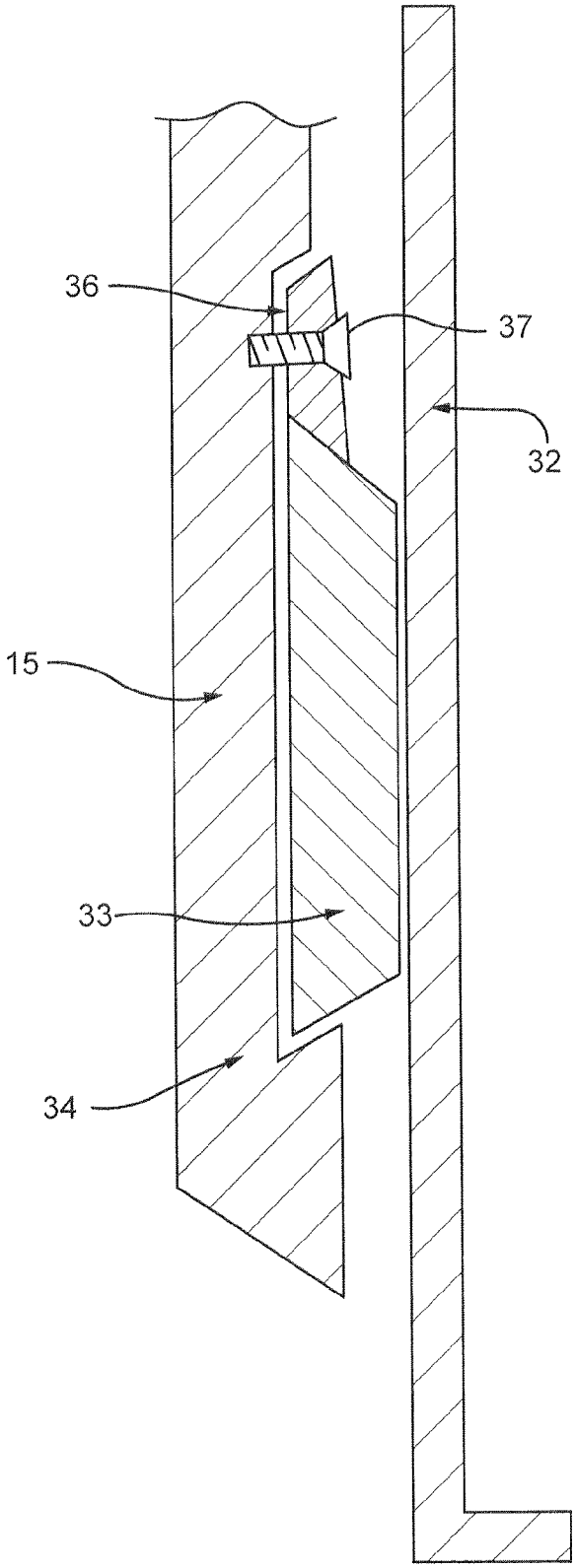
FIG. 3 is a schematic cross-sectional view of the cylindrical bearing sandwiched between the screen assembly and the bearing cylinder.

FIG. 3 is an enlarged cross-sectional view of the cylindrical bearing 33, the lower region of the screen assembly 15 and the bearing cylinder 32. The cylindrical bearing 33 may fit in an annular groove 34 in a surface of the lower region of the screen assembly 15. An annular array of clips 36 fit into recesses in the screen assembly and secures the sections of the bearing cylinder 32 in the groove 34. The metallic clips may be attached to the screen assembly by screws or bolts 37 that extend through the clip and into the screen assembly. The clips are removed to allow the cylindrical bearing to be removed from and replaced on the screen assembly.

Figure 5:
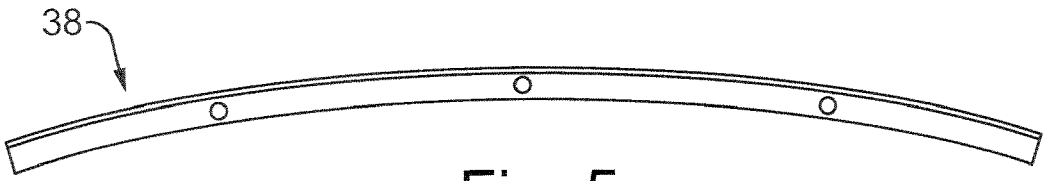
Figure 4:
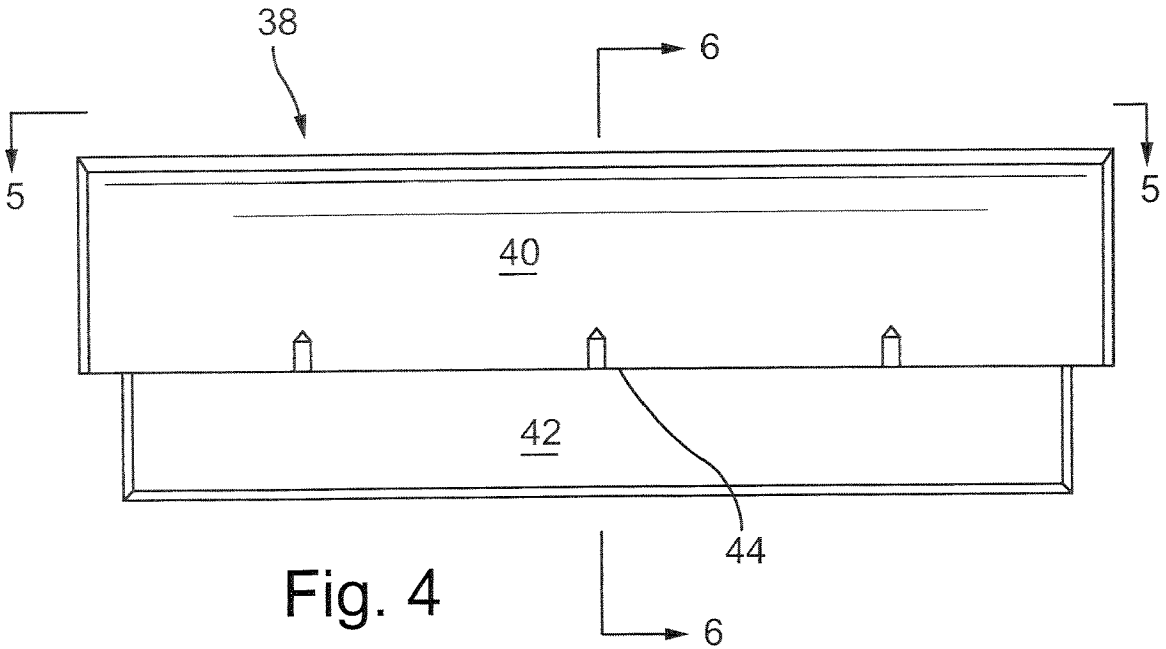
Figure 6:
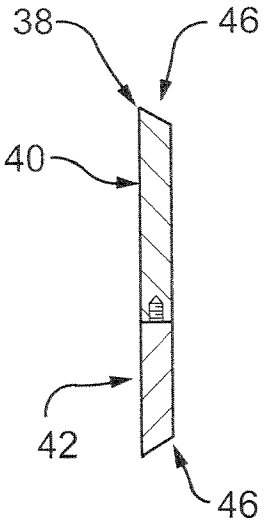

FIGS. 4, 5 and 6 are front, top and cross-sectional views, respectively of a section 38 of the cylindrical bearing 33. Each section 38 of the bearing is an arc. The sections are arranged side by side to form the cylindrical bearing. In some embodiments, eight to twelve sections 38 are arranged side-by-side to form the cylindrical bearing.

Conventional sections of cylindrical bearings were formed entirely of a uniform material, such as Rulon™. In contrast, the sections 38 of the bearings disclosed herein are formed of two materials. The first material has a hardness sufficient to resist damage due to sand, rocks and other impurity particles that may become caught between the surface of the first material and the opposing bearing surfaces of the screen assembly and bearing cylinder. The hardness of the first material should be sufficient such that sand, rock and other impurity particles do not embed in the surface of the material. For example, the first material may be a non-ferrous material, such as molybdenum, a carbon or glass filled thermoplastic material, such as polytetrafluoroethylene (PTFE), a graphite, a composite of graphite and a metal, and a ceramic. U.S. Pat. No. 6,834,862 discloses examples of materials that may be suitable for the first material. An example of the first material is a Pack Ryt™ material sold by Seal Ryt Corporation of Easthampton, Mass.

The second material is a softer material, such as Rulon™, that has a thermal expansion coefficient several times, e.g., ten times, the thermal expansion coefficient of the metal forming the screen assembly and bearing cylinder. As the second material expands under the heat of the operation of the pressure diffuser, the material expands to tightly fill the gap between the screen assembly and bearing cylinder and the material deforms to conform to the bearing surfaces of the screen assembly and bearing cylinder. The first material preferably has a thermal expansion coefficient less than the thermal expansion coefficient of the second material used to form the cylindrical. For example, the thermal expansion coefficient of the second material may be twice the thermal expansion coefficient of the first material. Similarly, the thermal expansion coefficients of the first and second material may be several orders of magnitude, e.g., ten orders, of the thermal expansion coefficient of the material, e.g., stainless steel, forming the screen assembly.

Each section 38 of the cylindrical bearing has a first panel 40 and a second panel 42. One panel is preferably formed of the first material which is hard and does not allow sand, rocks or other impurities to embed in its surface, and the other panel is formed of the second material which is softer, has a high thermal expansion coefficient and deforms to conform to the bearing surfaces opposite to the second material. The panel formed of the first material is arranged proximal to the annular volume chamber 12 for pulp (FIGS. 1 and 2) in the gap for the cylindrical bearing 33 between the screen assembly and the bearing cylinder. The panel formed of the second material is distal of the annular volume for pulp. Preferably, the panel, e.g., panel 42, formed of the first (harder) material has a shorter height (H) than the height of the panel, e.g., 40, formed of the second (softer) material.

The cylindrical bearing in the upper region of the pressure diffuser is above the pulp volume 15 and the cylindrical bearing in the lower region of the pressure diffuser is below the pulp volume. Accordingly, the lower panel of the cylindrical bearing in the upper region of the pressure diffuser is preferably formed of the first material. The upper panel of the cylindrical bearing in the lower region of the pressure diffuser is preferably formed of the first material.

The thickness of the first panel may be slightly greater than that of the second panel. In one embodiment, the thickness of the first (harder) panel may be 0.75 inches and the thickness of the second (softer) panel, when at ambient temperature, may be 0.72 inches thick. The greater thickness of the first (harder) panel ensures that the first panel will tightly seal in the gap between the screen assembly and the bearing cylinder, when the bearing is at ambient temperature. The tight seal form by the first panel ensures that sand and other impurity particles do not migrate onto the surfaces of the cylindrical bearing. As the cylindrical bearing is heated to the operating temperature of the pressure vessel, the thickness of the second panel expands, fills the gap between the screen assembly and the bearing cylinder and forms a tight seal in the gap that prevents the passage of fibers.

To attach the first and second panels 40, 42, the opposing longitudinal edges of the panels may be glued and pins 44 extend from an edge of one panel 42 may seat in holes on an opposite edge of the other panel 40. Alternatively, the opposing longitudinal edges of the panels may respectively have a tongue and groove or dovetail arrangement that seat together when the panels are attached. Further, at least one of the longitudinal edges 46 of the panels, which do not abut another panel, may have a bevel or slant adapted to fit into an overhanging edge of the annular groove in a side wall of the screen assembly.

The sections 38 of the cylindrical bearing are arranged side-by-side to for the bearing. In one section 38, the length (L) an upper panel 40 may be longer than the length of the lower panel 42. In an adjacent section 38, the length of the upper panel is shorter than the length of the lower pane. When the sections are side-by-side, the differences in lengths of the panels avoid a straight vertical line extending all the way through the height of the cylindrical bearing, which would allow pulp to flow past the cylindrical bearing and into the chamber 20 for the filtrate.

Figure 7:
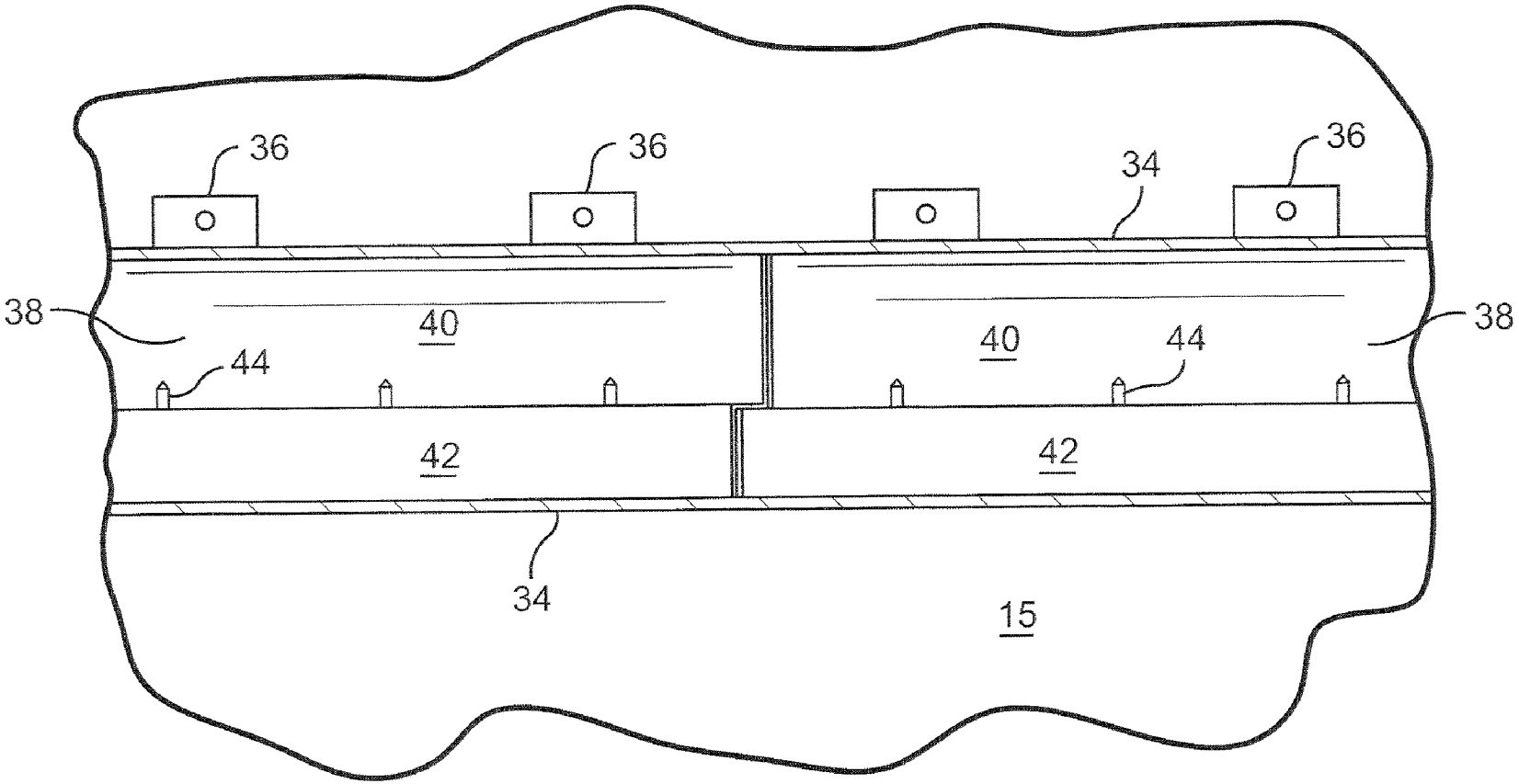
FIG. 7 is a front view of several sections of the bearing cylinder arranged side-by-side on a screen assembly.

FIG. 7 shows a front view of several sections of the bearing cylinder arranged side-by-side on a screen assembly 15. To assemble the cylindrical bearing, the sections 38 of the cylindrical bearing are sequentially placed in the annular groove 34 of the screen assembly. As each section is inserted, a clip(s) 36 is also mounted in the screen assembly to overlap an edge of the section. The clip is fixed to the screen assembly, such as by inserting a bolt through the clip and into the screen assembly. The clip holds the section 38 in the groove.

The sides of the sections abut against the sides of adjacent sections. The abutting sides form an irregular, i.e., non-vertical, joint between the sections 38. The irregular joint avoids creating a path through which fibers may flow. Further, the irregular joint provides structural support for the sections. The sections are arranged side-by-side in the groove to form the cylindrical bearing that extends around the circumference of the annular groove 34 of the screen assembly.

The operational life of the cylindrical bearing 33 is extended because sand and other impurity particles are prevented from entering the gap between the screen assembly and the bearing cylinder while the bearing is at ambient temperature and at the hot operating temperatures. The hard material of the panels 42 adjacent the pulp filled annular region ensures that sand and other impurities do not migrate onto the surfaces of the bearing and particularly onto the soft surfaces of the other panels 40 of the cylindrical bearing. By preventing sand and other impurity particles from reaching the bearing surfaces, these particles are less likely to damage the surfaces of the bearing and the operational life of the bearing is not degraded by such damage.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A cylindrical bearing for a screen assembly of a pressure diffuser, the cylindrical bearing comprising:

a plurality of segments of the bearing wherein the segments are arranged side-by-side to form a cylinder in a gap between a bearing cylinder and a screen assembly of the pressure diffuser, and each of said segments includes a first region formed of a hard material resistant to damage from sand and rocks, and a second region formed of a soft material that thermally expands and conforms to a surface of the bearing cylinder, wherein the first region is thicker than the second region prior to the thermal expansion.

2. The cylindrical bearing as in claim 1 wherein the first region is proximate to a pulp containing region of the diffuser and the second region is distal to the pulp containing region.

3. The cylindrical bearing as in claim 1 wherein the first region is formed of a material including at least one of molybdenum, a carbon or glass filled thermoplastic material, a composite of graphite and a metal, and a ceramic.

4. The cylindrical bearing as in claim 1 wherein the second region is formed of a fluorocarbon plastic.

5. A bearing assembly for a pressure diffuser comprising:

a screen assembly having an annular mounting surface;

a bearing cylinder coaxial with the screen assembly and having an annular bearing surface facing the mounting surface of the screen assembly;

an annular gap between the mounting surface of the screen assembly and the bearing surface of the bearing cylinder;

a cylindrical bearing mounted on the mounting surface and positioned in the gap, wherein the cylindrical bearing includes a first annular region formed of a hard material having a thickness greater than a second annular region formed of a soft material, wherein the soft material has a coefficient of thermal expansion at least two orders of magnitude greater than a thermal expansion coefficient of the screen assembly, wherein the first annular region is adjacent a pulp containing annular region of the pressure diffuser.

6. A bearing assembly for a pressure diffuser comprising:

a screen assembly having an annular mounting surface;

a bearing cylinder coaxial with the screen assembly and having an annular bearing surface facing the mounting surface of the screen assembly;

an annular gap between the mounting surface of the screen assembly and the bearing surface of the bearing cylinder;

a cylindrical bearing mounted on the mounting surface and positioned in the gap, wherein the cylindrical bearing includes a first annular region formed of a hard material having a thickness greater than a second annular region formed of a soft material, wherein the soft material has a coefficient of thermal expansion at least two orders of magnitude greater than a thermal expansion coefficient of the screen assembly, wherein the first annular region is thicker than the second annular region, and the thickness of the first region seals the gap when the pressure diffuser is at ambient temperatures.

7. The bearing assembly as in claim 6 wherein the cylindrical bearing comprises an annular array of bearing segments arranged side-by-side on the mounting surface.

8. The bearing assembly as in claim 6 wherein the first annular region is formed of at least one of molybdenum, a carbon or glass filled thermoplastic material, a composite of graphite and a metal, and a ceramic.

9. The bearing assembly as in claim 6 wherein the second annular region is formed of a fluorocarbon plastic.

10. The bearing assembly as in claim 6 wherein the mounting surface of the screen assembly is an annular groove in the screen assembly, and the bearing assembly further comprises a plurality of clips attachable to the groove, wherein the clips secure the cylindrical bearing in the groove.

11. A method to minimize damage to a bearing cylinder in a pressure diffuser comprising:

affixing a cylindrical bearing to a screen assembly of the pressure diffuser, wherein the cylindrical bearing includes a first annular section formed of a hard material and a second annular section formed of a soft material which is softer than the hard material, wherein the first annular region is positioned to be adjacent a pulp containing annular region of the pressure diffuser;

seating the screen assembly with the cylindrical bearing in a bearing cylinder to mount the screen assembly in the pressure diffuser, wherein the cylindrical bearing is adjacent the bearing cylinder;

washing pulp in an annular chamber of the pressure diffuser, and extracting filtrate from the pulp, through the screen assembly and into a filtrate chamber;

preventing sand, rock and other particles in the pulp from embedding in a surface of the first annular section due to the hard material of the first annular section;

blocking by the first annular section, the sand, rock and other particles from migrating through a gap between the cylindrical bearing and the bearing cylinder to the second annular section, and moving the screen assembly with cylindrical bearings with respect to the bearing cylinders, wherein the sand, rock and other particles are not substantially embedded in the first annular section or the second annular section of the cylindrical bearing.

12. A method in claim 11 wherein the affixing step includes arranging bearing segments side-by-side to form the cylindrical bearing.

13. The method in claim 11 wherein the method further comprises thermally expanding the second annular section at a greater expansion rate than the first annular section during a starting operation of the pressure diffuser.

14. The method in claim 11 wherein the affixing step includes attaching a plurality of clips to secure the cylindrical bearing in a groove of the screen assembly.

15. A method to minimize damage to a bearing cylinder in a pressure diffuser comprising:

affixing a cylindrical bearing to a screen assembly of the pressure diffuser, wherein the cylindrical bearing includes a first annular section formed of a hard material and a second annular section formed of a soft material which is softer than the hard material, wherein the first annular section is thicker than the second section region;

seating the screen assembly with the cylindrical bearing in a bearing cylinder to mount the screen assembly in the pressure diffuser, wherein the cylindrical bearing is adjacent the bearing cylinder;

washing pulp in an annular chamber of the pressure diffuser, and extracting filtrate from the pulp, through the screen assembly and into a filtrate chamber;

preventing sand, rock and other particles in the pulp from embedding in a surface of the first annular section due to the hard material of the first annular section;

blocking by the first annular section, the sand, rock and other particles from migrating through a gap between the cylindrical bearing and the bearing cylinder to the second annular section;

the first annular section sealing the gap while the pressure diffuser is in a startup operation and before the pressure diffuser heats to an operating temperature, and moving the screen assembly with cylindrical bearings with respect to the bearing cylinders, wherein the sand, rock and other particles are not substantially embedded in the first annular section or the second annular section of the cylindrical bearing.

* * * * *